US006457456B1

(12) United States Patent
Scollard et al.

(10) Patent No.: US 6,457,456 B1
(45) Date of Patent: Oct. 1, 2002

(54) CLIP FOR INJECTOR TO FUEL SUPPLY ASSEMBLY

(75) Inventors: Joseph Edward Scollard, Suffolk; Stephen C. Bugos, Newport News; Timothy S. Roach, Norfolk; David Matthew Schandel, Newport News, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/628,448

(22) Filed: Jul. 28, 2000

(51) Int. Cl.[7] ..... F02M 39/00
(52) U.S. Cl. ..... 123/470
(58) Field of Search ..... 123/468, 469, 123/470

(56) References Cited

U.S. PATENT DOCUMENTS

| | | | | | |
|---|---|---|---|---|---|
| 4,984,548 | A | | 1/1991 | Hudson, Jr. | 123/470 |
| 4,991,557 | A | * | 2/1991 | DeGrace et al. | 123/470 |
| 5,038,738 | A | * | 8/1991 | Hafner et al. | 123/470 |
| 5,111,794 | A | | 5/1992 | DeGrace, Jr. | 123/470 |
| 5,168,625 | A | | 12/1992 | DeGrace, Jr. | 123/470 |
| 5,209,204 | A | | 5/1993 | Bodenhausen et al. | 123/470 |
| 5,211,149 | A | | 5/1993 | DeGrace, Jr. | 123/470 |
| 5,301,647 | A | | 4/1994 | Lorraine | 123/470 |
| 5,350,314 | A | | 9/1994 | Saba | 439/378 |
| 5,520,151 | A | * | 5/1996 | Gras et al. | 123/470 |
| 5,598,824 | A | | 2/1997 | Treusch et al. | 123/470 |
| 5,724,946 | A | | 3/1998 | Franchitto | 123/470 |
| 5,743,235 | A | | 4/1998 | Lueder | 123/468 |
| 5,803,052 | A | * | 9/1998 | Lorraine et al. | 123/470 |
| 5,893,351 | A | | 4/1999 | Akutagawa et al. | 123/470 |
| 5,934,253 | A | | 8/1999 | Kojima et al. | 123/470 |
| 5,934,254 | A | | 8/1999 | Vetters et al. | 123/470 |
| 5,960,774 | A | | 10/1999 | Norgauer et al. | 123/470 |
| 5,967,121 | A | | 10/1999 | Pirch et al. | 123/470 |
| 5,970,953 | A | * | 10/1999 | Lorraine et al. | 123/470 |
| 6,053,149 | A | * | 4/2000 | Lorraine | 123/470 |
| 6,276,339 | B1 | * | 8/2001 | Shebert, Jr. et al. | 123/470 |
| 6,283,772 | B1 | * | 9/2001 | Braun et al. | 123/470 |

* cited by examiner

*Primary Examiner*—Tony M. Argenbright
*Assistant Examiner*—Hai H. Huynh

(57) ABSTRACT

The present invention provides an assembly having a fuel injector and a fuel supply device. The fuel injector has a first and second end, a fuel metering portion with a longitudinal axis extending therethrough, an outer shell surrounding the fuel metering portion and at least one fixing member that extends generally radially from the outer shell. The fixing member has a leg, where a portion of the leg is substantially parallel to the longitudinal axis. A cross member is located transverse to the portion of the leg and has a projection that has a substantially planar surface and extends toward the outer shell. The fuel supply device has a cup with an injector receiving opening and at least one connecting member with a mating surface adapted to engage the substantially planar surface of the fixing member. A method of connecting the fuel cup to the fuel injector and a method of disengaging the fuel cup from the fuel injector is also provided.

20 Claims, 3 Drawing Sheets

CLIP FOR INJECTOR TO FUEL SUPPLY ASSEMBLY

FIELD OF INVENTION

The present invention relates to the field of fuel supply assemblies, and more particularly, to a clip for attachment of a fuel injector to a fuel supply device.

BACKGROUND OF INVENTION

There are many types of attachment devices to retain a fuel injector to a fuel supply device. The attachment device may be a clip that secures a fuel injector inserted into a cup, which is part of the fuel supply device. Each clip is a separate part and thus, it is believed that elimination of the clip will reduce the number of parts required in the assembly of a fuel supply system.

SUMMARY OF THE INVENTION

The present invention provides a fuel supply assembly having a fuel injector and a fuel supply device. The fuel injector has a first and second end, a fuel metering portion with a longitudinal axis extending therethrough, an outer shell surrounding the fuel metering portion and at least one fixing member. The fixing member extends generally radially from the outer shell proximate to the first end and has a leg, a portion of which is substantially parallel to the longitudinal axis. A cross member is located transverse to the portion of the leg and has a projection that has a substantially planar surface and that extends toward the outer shell. The fuel supply device has a cup with an injector receiving opening and at least one connecting member. The connecting member has a mating surface adapted to engage the substantially planar surface of the fixing member.

The present invention also provides a method of connecting a fuel cup to a fuel injector. The method includes: providing a fuel injector, having a first and second end and a longitudinal axis extending therethrough, and a fuel supply device, where the fuel injector includes an outer shell and at least one fixing member that extends generally radially from the outer shell and that has a cross member transverse to the leg, where the cross member has a projection, which has a substantially planar surface and extends toward the outer shell, and a surface extending toward the second end and toward the longitudinal axis, and the fuel supply device has a cup with at least one connecting member, where the connecting member has a mating surface; inserting the cup over the first end of the fuel injector; engaging the at least one fixing member with the surface extending toward the second end; biasing the surface extending toward the second end and the cross member from a first position to a second position away from the longitudinal axis; and engaging the substantially planar surface of the projection with the mating surface of the connecting member so that the cross member returns toward the first position.

The present invention also provides a method of disengaging a fuel cup from a fuel injector. This method includes: providing a fuel injector, having a first and second end and a longitudinal axis extending therethrough, and a fuel supply device, where the fuel injector includes an outer shell and at least one fixing member that extends generally radially from the outer shell and that has a cross member transverse to the leg, where the cross member has a projection, which has a substantially planar surface and extends toward the outer shell, and a surface extending toward the second end and toward the longitudinal axis, and the fuel supply device has a cup with at least one connecting member, where the connecting member has a mating surface; pressing the cup into the fuel injector along the longitudinal axis; biasing the cross member from a first position to a second position away from the longitudinal axis, where the mating surface of the connecting member releases from the substantially planar surface of the projection; and advancing the cup along the longitudinal axis away from the second end and releasing the projection so that the cross member returning toward the first position.

BRIEF DESCRIPTION OF THE DRAWINGS

The accompanying drawings, which are incorporated herein and constitute part of this specification, illustrate the presently preferred embodiment of the invention, and, together with the general description given above and the detailed description given below, serve to explain the features of the invention.

DETAILED DESCRIPTION OF THE PREFERRED EMBODIMENT

Figure 1:
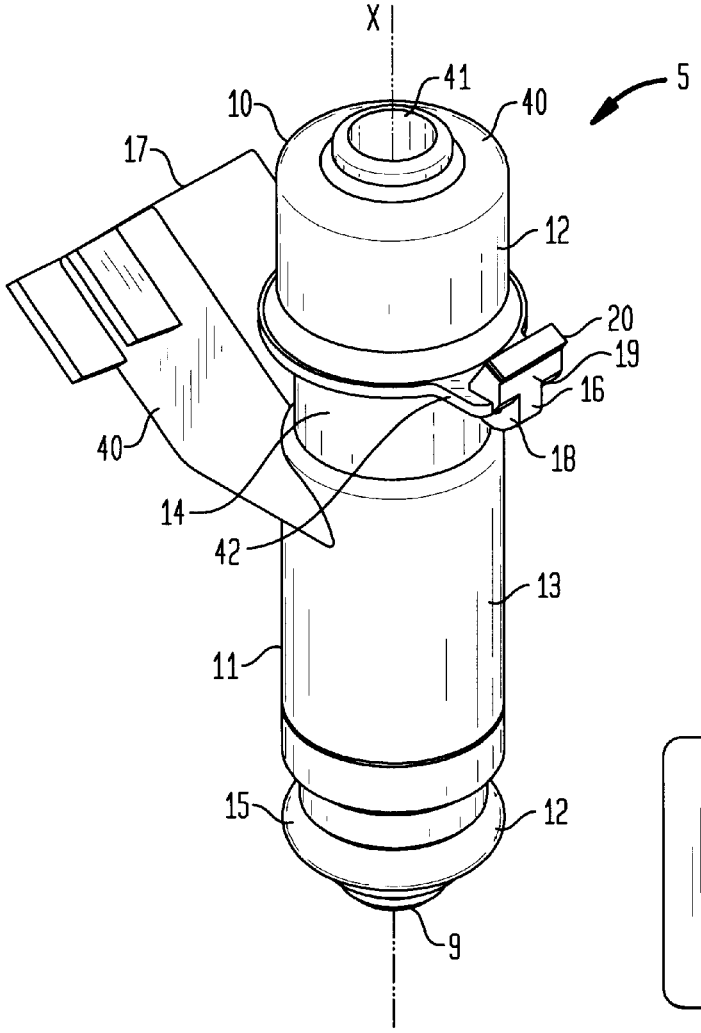
FIG. 1 is a top-frontal view of a first embodiment of the assembly of the present invention.
Figure 2:
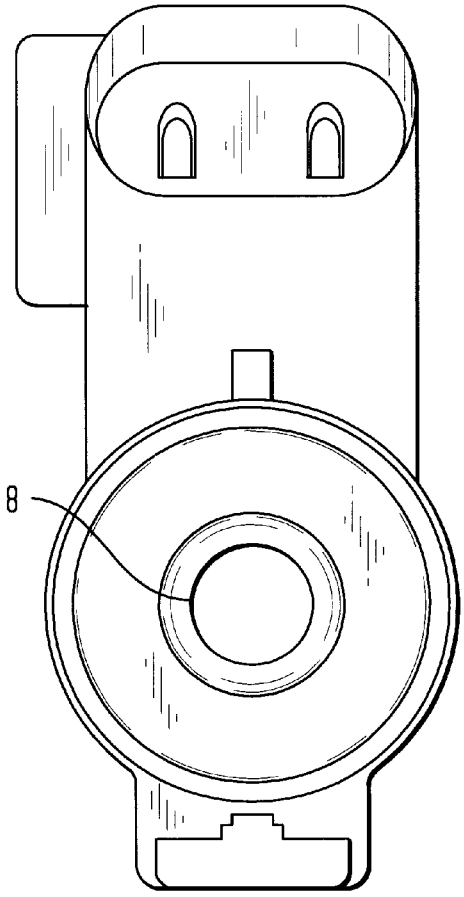
FIG. 2 is a top view of the assembly of FIG. 1
Figure 3:
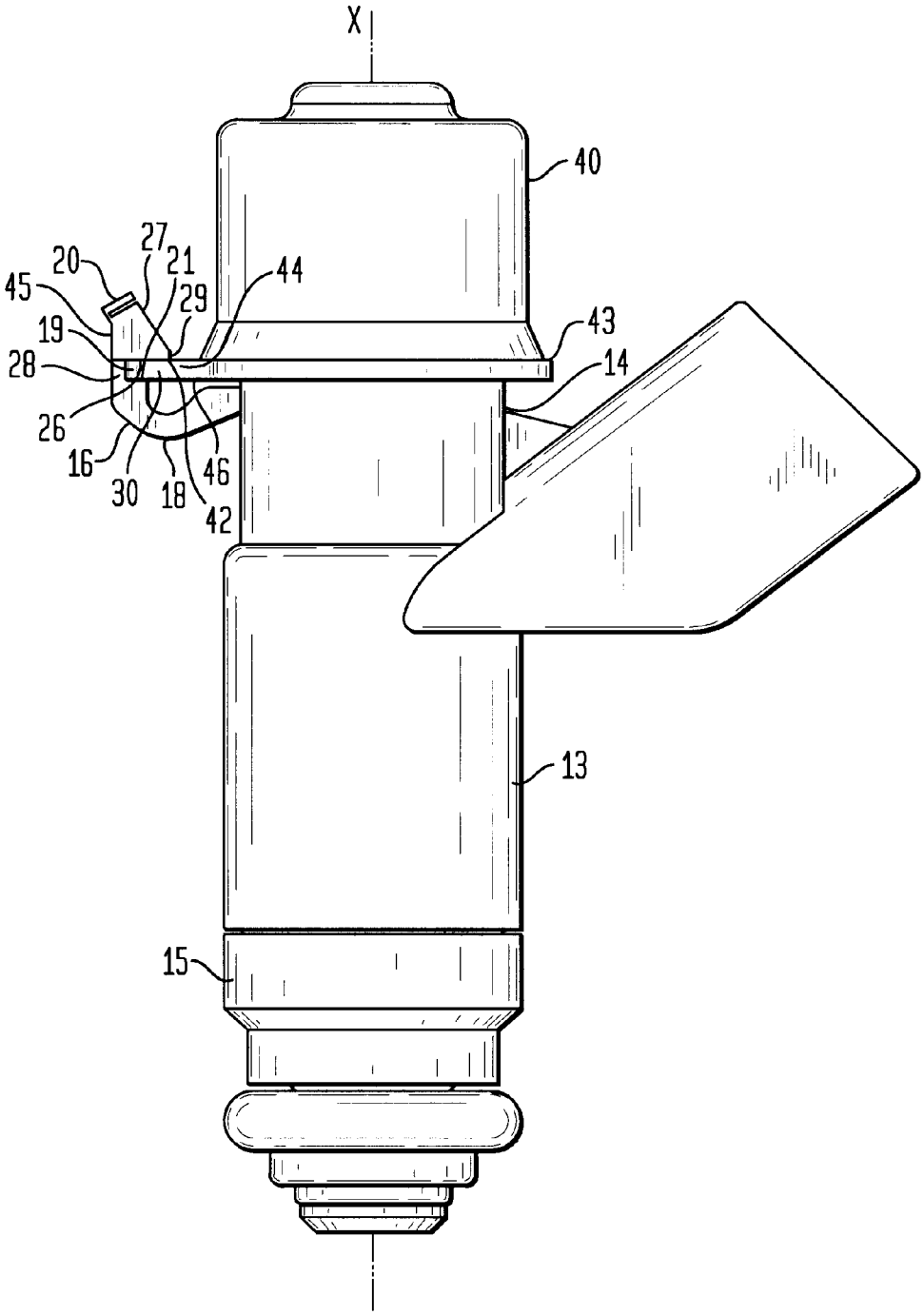
FIG. 3 is a side view of the assembly of FIG. 1.

In the drawings, like numerals are used to indicate like elements throughout. FIGS. 1–3 illustrate a first embodiment of an assembly 5 that releasably engages a fuel supply device 10 to a fuel injector 11. As shown in FIG. 1, the fuel injector 1 has a fuel metering portion 12 with a longitudinal axis x extending therethrough and first and second ends, 14 and 15, respectively. An outer shell 13 surrounds the fuel metering portion 12. Fuel flows into the fuel metering portion 12 into a fuel inlet 8, as shown in FIG. 2, proximate the first end 14 of the fuel injector 11 and exits the fuel metering portion 12 out of a fuel outlet 9 proximate the second end 15 of the fuel injector 11. At least one fixing member 16 extends generally radially from the outer shell 13 proximate the first end 14. Preferably, there is one fixing member 16 diametrically opposed from an electrical connector 17 extending from the outer shell 13. However, there may two or more fixing members 16 extending radially from the outer shell 13. The fuel supply assembly may also include a fuel channel (not shown) that supplies fuel to the fuel injector 11 and an electrical connector receptacle (not shown) that engages the electrical connector 17.

The fixing member 16 has a leg 18 with a portion 19 that is substantially parallel to the longitudinal axis x. The fixing member 16 also has a cross member 20 transverse to the portion 19. The cross member 20 has a projection 21 with a substantially planar surface 26, as shown in FIG. 3. Preferably, the cross member 20 is biased toward the first end 14 of the fuel injector 11. Preferably, the cross member 20 and projection 21 have a surface 27 extending toward the second end 15 of the outer shell 13 and toward the longitudinal axis x. The fixing member 16 also has a recess 28 defined by the substantially planar surface 26 and the portion 19. The recess 28 has a first surface 29 adjacent to the substantially planar surface 26 and a second surface 30 adjacent to the first surface 29. Preferably, the second surface 30 is substantially parallel to the substantially planar surface 26.

The fuel supply device 10 has a cup 40 with an injector receiving opening 41 and a connecting member, or tab 42, extending generally radially from the cup 40. In the preferred embodiment, there is one tab 42, but there may be two tabs located around the cup 40 that releasably engage two fixing members (not shown). The first end 14 of the fuel injector 11 is disposed in the injector receiving opening 41. Preferably, there is a lip 43, which is interposed between the tab 42 and the cup 40, surrounding the cup 40. The tab 42 may extend generally radially from the lip 43 or the cup 40. The tab 42 has a mating surface 44 that engages the substantially planar surface 26 of the fixing member 16. Preferably, the tab 42 has a first surface 45 adjacent to the mating surface 44 and a second surface 46 adjacent to the first surface 46. Preferably, the mating surface 44 is substantially parallel to the second surface 46.

In the first embodiment, when the cup 40 is installed over the first end 14 of the fuel injector 11, the tab 42 extends into the recess 28 so that the substantially planar surface 26 releasably engages the mating surface 44 of the tab 42. Preferably, the fixing member 16 limits axial and rotational movement of the cup 40 with respect to the fuel injector 11 when the tab 42 is inserted into the recess 28. The mating surface 44 is preferably facing away from second end 15 of the fuel injector 11 and transverse to the longitudinal axis x. Preferably, the first and second surfaces 45 and 46 of the tab 42 also releasably engage the first and second surfaces 29 and 30 of the recess 28.

To releasably connect the cup 40 to the fuel injector 11, the cup 40 is inserted over the first end 14 of the fuel injector 11. The tab 42 engages the surface 27 and biases the cross member 20 from a first position to a second position away from the longitudinal axis x. The tab 42 enters the recess 28. As the tab 42 enters the recess 28, the cross member 20 returns to the first position. The mating surface 44 of the tab 42 engages the substantially planar surface 26 of the fixing member 16.

To disengage the cup 40 from the fuel injector 11, the cup 40 is pressed toward the second end 15 of the fuel injector 11 along the longitudinal axis x, and the cross member 20 is biased from the first position to the second position away from the longitudinal axis x. The second position of the connection may not be the same as the second position of the disengagement. The mating surface 44 releases from the substantially planar surface 26 and exits the recess 28. The cup 40 is then advanced along the longitudinal axis x away from the second end 15 of the fuel injector 11. The cross member 20 is released and returns to the first position.

Figure 4:
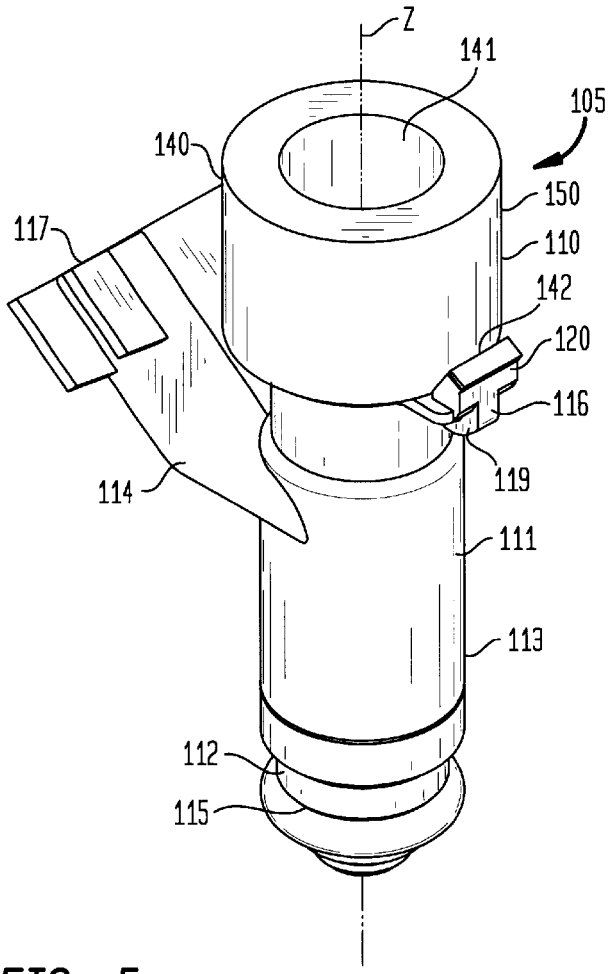
FIG. 4 is a top-frontal view of a second embodiment of the assembly of the present invention.
Figure 5:
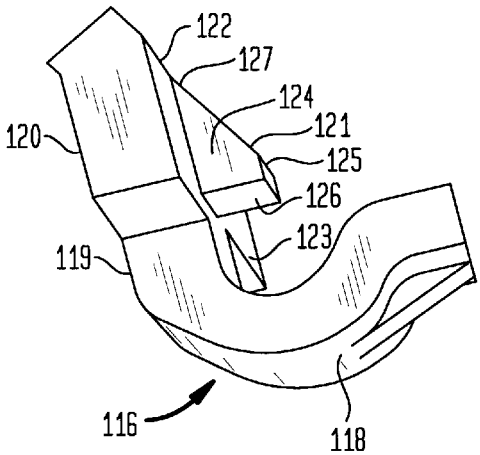
FIG. 5 is an angled side view of a fixing member of the assembly of FIG. 4.
Figure 6:
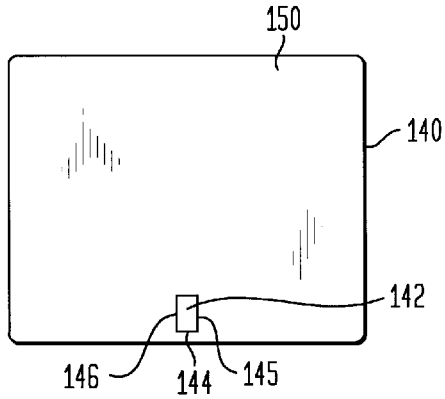
FIG. 6 is a frontal view of a cup of the assembly of FIG. 4.

The second embodiment is shown in FIGS. 4–6. Although not all of the features of the first embodiment are discussed below, these features may also be incorporated into the second embodiment. FIG. 4 illustrates an assembly 105 that releasably engages a fuel supply device 110 to a fuel injector 111. The fuel injector 111 has a fuel metering portion 112 with a longitudinal axis z extending therethrough and first and second ends, 114 and 115, respectively. An outer shell 113 surrounds the fuel metering portion 112. Fuel flows into the fuel metering portion 112 proximate the first end 114 of the fuel injector 111 and exits the fuel metering portion 112 proximate the second end 115 of the fuel injector 111. At least one fixing member 116 extends generally radially from the outer shell 113 proximate the first end 114. Preferably, there is one fixing member 116 diametrically opposed from an electrical connector 117 extending from the outer shell 113.

The fixing member 116 has a leg 118,with a portion 119 that is substantially parallel to the longitudinal axis z, as shown in FIG. 5. The fixing member 116 also has a cross member 120 transverse to the portion 119. The cross member 120 has a projection 121 with a substantially planar surface 126. Preferably, the cross member 210 is biased toward the first end 114 of the fuel injector 111 . Preferably, the cross member 120 and projection 121 have a surface 127 extending toward the second end 115 of the outer shell 113 and toward the longitudinal axis z. The projection 121 has a first and second wall 124 and 125, preferably, substantially parallel to one another. The cross member 120 has first and second surfaces 122 and 123, respectively, adjacent to the first and second walls 124 and 125, respectively, of the projection 121. Preferably, the first and second surfaces 122 and 123 are also transverse to the first and second walls 124 and 125. The fixing member 116 may also be used with the cup 40 of the first embodiment.

The fuel supply device 110 has a cup 140 with an injector receiving opening 141 and a connecting member, or slot 142 within the cup 140. In the preferred embodiment, there is one slot 142, but there may be two slots located around the cup 140 that releasably engage two fixing members (not shown). The first end 114 of the fuel injector 111 is disposed in the injector receiving opening 141. The slot 142 has a mating surface 144, as shown in FIG. 6, that engages the substantially planar surface 126 of the fixing member 116. The fixing member 16 of the first embodiment may be also be used with cup 140. The slot 142 has first and second sides 145 and 146. Preferably, the first side 145 is substantially parallel to the second side 146 and the longitudinal axis z.

In the second embodiment, when the cup 140 is installed over the first end 114 of the fuel injector 111, the projection 121 extends into the slot 142 so that the substantially planar surface 126 releasably engages the mating surface 144 of the slot 142. Preferably, the fixing member 116 limits axial and rotational movement of the cup 140 with respect to the fuel injector 111 when the projection 121 is inserted into the slot 142. The mating surface 144 is preferably facing away from second end 115 of the fuel injector 11 and transverse to the longitudinal axis z. The first and second sides 145 and 146 of the slot 142 may releasably engage the first and second walls 124 and 125 of the projection 121. The first and second surfaces 122 and 123 may also releasably engage a surface 150 of the cup 140.

To releasably connect the cup 140 to the fuel injector 111, the cup 140 is inserted over the first end 114 of the fuel injector 111. The cup 140 engages the surface 127 and biases and the cross member 120 from a first position to a second position away from the longitudinal axis z. The projection 121 enters the slot 142. As the cup 140 is further inserted over the fuel injector 111, projection 121 rides along the surface 150 and enters the slot 142. The cross member 20 returns toward the first position. The mating surface 144 of the slot 142 engages the substantially planar surface 26 of the fixing member 116.

To disengage the cup 140 from the fuel injector 111, the cup 140 is pressed toward the second end 115 of the fuel injector 111 along the longitudinal axis z, and the cross member 120 is biased from the first position to the second position away from the longitudinal axis z. The second position of the connection may not be the same as the second position of the disengagement. The substantially planar surface 26 releases from the mating surface 144 and exits the slot 142. The cup 140 is then advanced along the longitudinal axis z away from the second end 115 of the fuel injector 111. The cross member 120 is released and returns to the first position.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What we claim is:

1. A fuel supply assembly comprising:

a fuel injector, having first and second ends, including:

a fuel metering portion having a longitudinal axis extending therethrough;

an outer shell surrounding the fuel metering portion; and at least one fixing member, having a leg extending generally radially from the outer shell proximate the first end, a portion of the leg being substantially parallel to the longitudinal axis, a cross member extending from and transverse to the portion of the leg, the cross member having a projection extending towards the outer shell and having a substantially planar surface; and a fuel supply device having a cup, the cup including:

an injector receiving opening; and at least one connecting member having a mating surface adapted to engage the substantially planar surface of the fixing member.

2. The fuel supply assembly of claim 1 wherein the cross member further comprises a first and second surface adjacent a first and second wall of the projection.

3. The fuel supply assembly of claim 2 wherein the connecting member comprises a slot within the cup.

4. The fuel supply assembly of claim 3 wherein the first and second wall of the projection engage a first and second side of the slot.

5. The fuel supply device of claim 2, wherein the first and second surfaces are also transverse to the first and second wall.

6. The fuel supply assembly of claim 1 wherein the connecting member comprises a tab extending generally radially from the cup.

7. The fuel supply assembly of claim 6 wherein the tab comprises a first surface adjacent the mating surface and a second surface adjacent the first surface.

8. The fuel supply assembly of claim 7 wherein the at least one fixing member further comprises a recess, defined by the substantially planar surface and the portion of the leg, the recess having a first recess surface adjacent the substantially planar surface and a second recess surface adjacent the first recess surface.

9. The fuel supply assembly of claim 8 wherein the first and second surfaces of the tab engage the first and second recess surfaces.

10. The fuel supply assembly of claim 1 wherein the cross member comprises a surface extending toward the second end of the fuel injector and toward the longitudinal axis.

11. The fuel supply assembly of claim 10 wherein the projection comprises a surface extending toward the second end of the fuel injector and toward the longitudinal axis.

12. The fuel supply assembly of claim 1 wherein the fuel injector further comprises an electrical connector extending from the outer shell, the at least one fixing member being diametrically opposed from the electrical connector.

13. The fuel supply assembly of claim 1 wherein the fuel injector further comprises:

a fuel inlet at the first end of the fuel injector that communicates with the injector receiving opening of the fuel supply device;

a fuel outlet at the second end of the fuel injector; and an electrical connector, proximate the fuel inlet.

14. The fuel supply assembly of claim 1 wherein the cross member is biased toward the first end of the fuel injector.

15. The fuel supply assembly of claim 1 wherein when the at least one fixing member engages the at least one connecting member, the fixing member limits axial and rotational movement of the cup with respect to the fuel injector.

16. The fuel supply assembly of claim 1 wherein the fuel supply device further comprises a lip, surrounding a portion of the cup, interposed between the at least one connecting member and the cup.

17. A method of connecting a fuel cup to a fuel injector comprising:

providing a fuel injector, having a first and second end and a longitudinal axis extending therethrough, and a fuel supply device, the fuel injector including an outer shell and at least one fixing member, having a leg extending generally radially from the outer shell, a portion of the leg being substantially parallel to the longitudinal axis, the at least one fixing member having a cross member extending from and transverse to the portion of the leg, the cross member having a projection, the projection having a substantially planar surface and extending toward the outer shell, the cross member having a surface extending toward the second end and toward the longitudinal axis, the fuel supply device having a cup with at least one connecting member, the connecting member having a mating surface;

inserting the cup over the first end of the fuel injector; and engaging the at least one fixing member with the surface extending toward the second end;

biasing the surface extending toward the second end and the cross member from a first position to a second position away from the longitudinal axis; and engaging the substantially planar surface of the projection with the mating surface of the connecting member, the cross member returning toward the first position so as to limit axial and rotational movement of the cup relative to the fuel injector.

18. The method of claim 17 wherein the engaging comprises:

inserting the projection into a slot within the cup such that a first and second wall of the projection engages a first and second side of the slot.

19. The method of claim 17 wherein the engaging comprises:

providing a recess defined by the substantially planar surface and a portion of the leg; and communicating a first and second surface of the recess with a first and second surface of the connecting member.

20. A method of disengaging a fuel cup from a fuel injector comprising:

providing a fuel injector, having a first and second end and a longitudinal axis extending therethrough, and a fuel supply device, the fuel injector including an outer shell and at least one fixing member extending generally radially from the outer shell, the at least one fixing member having a cross member with a projection having a substantially planar surface and extending toward the outer shell, the cross member having a surface extending toward the second end and toward the longitudinal axis, the fuel supply device having a cup with at least one connecting member, the connecting member having a mating surface;

pressing the cup into the fuel injector toward the second end along the longitudinal axis;

biasing the cross member from a first position to a second position away from the longitudinal axis, the mating surface of the connecting member releasing from the substantially planar surface of the projection; and advancing the cup along the longitudinal axis away from the second end and releasing the projection, the cross member returning toward the first position.

* * * * *